United States Patent [19]

Felder et al.

[11] 4,022,430

[45] May 10, 1977

[54] SUCKER ROD ADJUSTMENT TOOL

[76] Inventors: Donald Wayne Felder, 837 Hillside Drive; Ralph Felder, 1609 S. Vaden, both of Sherman, Tex. 75090; Orville Monroe, 2641 E. 59th St., Tulsa, Okla. 74145

[22] Filed: Aug. 19, 1976

[21] Appl. No.: 715,931

[52] U.S. Cl. ..... 254/106

[51] Int. Cl.[2] ..... B66F 1/00

[58] Field of Search ..... 254/105–107

[56] References Cited

UNITED STATES PATENTS

| | | | |
|---|---|---|---|
| 3,085,787 | 4/1963 | Gattnar et al. | 254/106 |
| 3,203,669 | 8/1965 | Johansson | 254/107 |
| 3,325,146 | 6/1967 | Ahl | 254/106 |

*Primary Examiner*—Al Lawrence Smith
*Assistant Examiner*—Robert C. Watson

[57] ABSTRACT

Disclosed is a sucker rod adjustment tool which enables the adjustment of effective sucker rod length for pumps used in oil wells, to be made in an efficient and timely manner. The tool consists of two cable slings from which two hydraulic servos are suspended and a lifting collar is attached at the lower ends of the hydraulic servos; all so arranged as to lift the sucker rod through its supporting member to allow adjustment when the hydraulic servos are retracted.

3 Claims, 4 Drawing Figures

SUCKER ROD ADJUSTMENT TOOL

SUMMARY OF THE INVENTION

The pumping mechanism utilized by the petroleum industry in removing crude oil from the ground require sucker rod adjustments from time to time due to rod strech and when length of stroke is changed on pump jack. The most common practice at present to make such adjustment is the utilization of a wench truck or a pulling unit. Both practices are costly in terms of manpower and equipment. Our invention provides a means whereby this adjustment can be made in a reasonably short time by one man, thus eliminating tying up expensive equipment and excessive manpower and also putting the well back into production without costly delay.

Our invention uses two cable slings draped across the sucker rod supporting member, (there are numerous sizes and shapes of supporting members in use and cables allow universal usage) and attached at the cylinder end of the two hydraulic servos. The servos are thus suspended and hang below the sucker rod support member. The piston rod eyes of the hydraulic servos are attached to the lifting collar assembly; so designed as to allow the sucker rod to pass between the two parts. The assembly is held together by bolts and nuts and where permissible with pins to allow faster instalation and removal of the assembly. A rod clamp is attached securely to the sucker rod just above the lift collar. Hydraulic pressure is then applied to the servos causing them to retract, this in turn raises the lift collar into contact with the rod clamp which in turn causes the sucker rod to move up through the sucker rod supporting member. The sucker rod has a rod clamp on the top side of the supporting member as a retaining device. This rod clamp is in turn loosened and moved down the sucker rod until it is once again in contact with the sucker rod supporting member, where it is tightened to again retain the sucker rod when the pressure is removed from the servos. The process can be repeated as many times as necessary to adjust the length of the rod string to acquire the desired pump stroke. This process can be reversed to lengthen as well as shorten the effective sucker rod string length.

DETAILED DESCRIPTION

Figure 1:
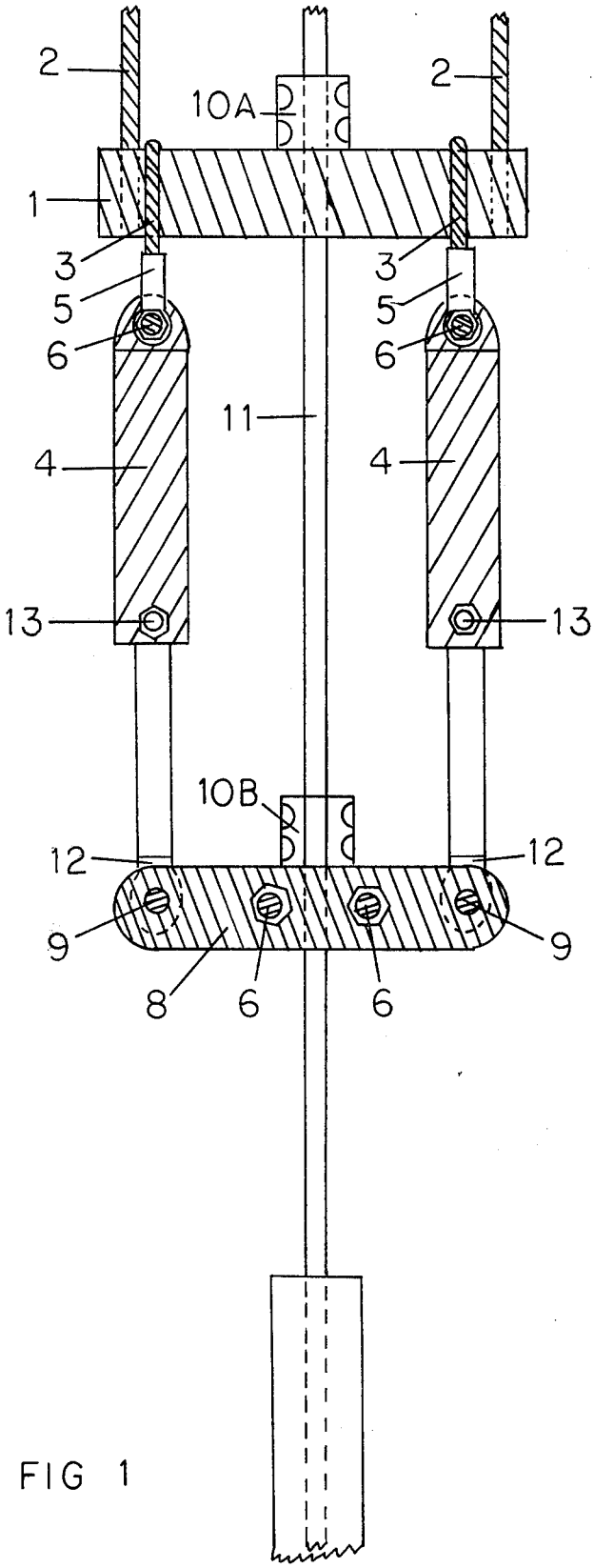
FIG. 1 is an overall front view of the assembled sucker rod adjusting tool, as it would appear when suspended below the sucker rod supporting member.

The same reference numerals refer to corresponding parts throughout the views.

FIG. 1 shows the sucker rod adjustment tool as it appears fully assembled and extended, suspended below the sucker rod supporting member 1. The harness 2 which suspends the sucker rod support member 1, lifts and lowers as the pumping jack (not shown) moves up and down. There are numerous sizes and shapes of sucker rod supporting members 1 in use, so in order to make the tool universal cable slings 3 are used to suspend and support the tool. The cable slings 3 are attached to the cylinder end of the hydraulic servos 4 by means of eye type swaged terminal ends 5 fitting with a bolt and nut 6 as the retainer. The rod eyes 12 of the hydraulic servos pass between the lifting collar 7 and the lifting collar cap 8, where it is secured in position by pins 9. A conventional sucker rod clamp 10A prevents the sucker rod 11 from slipping through the support member 1 during the lifting cycle in normal operation. The rod clamp 10B is used in conjunction with the lifting collar 7 and lifting collar cap 8 during the adjustment process.

Figure 2:
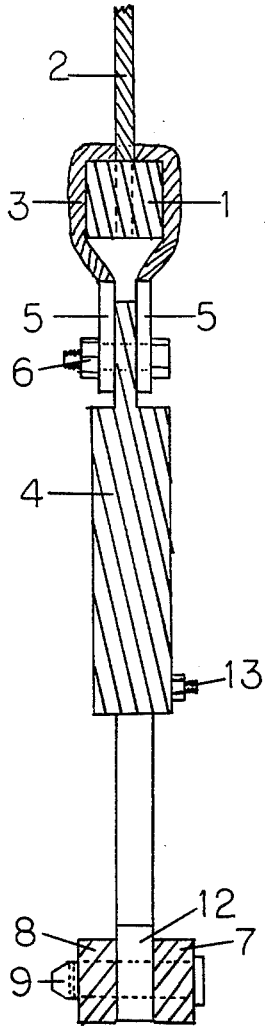
FIG. 2 is a side view of the assembled sucker rod adjusting tool as it appears when suspended below the sucker rod supporting member.

FIG. 2 shows the assembled and suspended tool in profile without the sucker rod shown. The hydraulic hose supplying fluid pressure to the hydraulic cylinder has also been omited as they are of conventional type.

Figure 3:
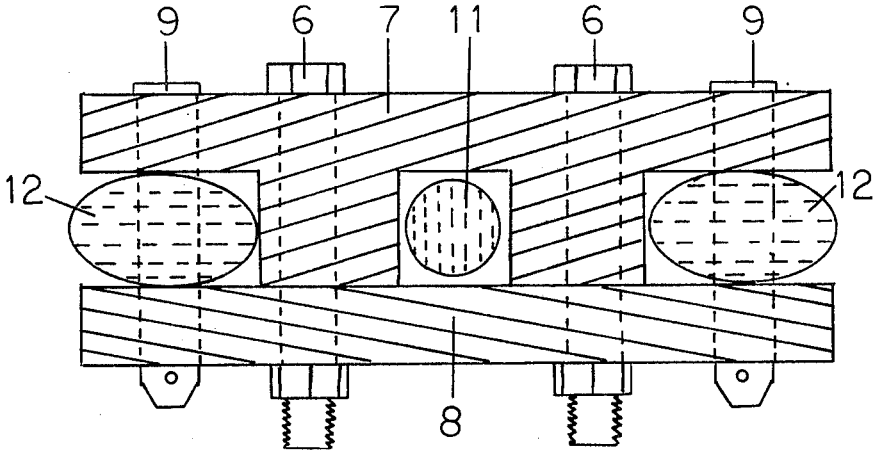
FIG. 3 shows the lifting collar as viewed from the bottom.

FIG. 3 shows the lifting collar 7 and lifting collar cap 8 viewed from the bottom when assembled for operation. The protrusions on the inside face of the lifting collar 7 are of sufficient dimension and seperation to allow sucker rod 11 of various sizes to pass between the protrusions of base lifting collar 7 and lifting collar cap 8 without restriction, allowing universal usage. The lifting collar 7 and cap 8 are securely fastened together during the adjustment process by two bolts and nuts 6, through the two inboard holes. The rod eye fittings 12 of the hydraulic servos 4 are held in position at the two outboard holes by pins 9 which have retaining pins (not shown) to prevent their being inadvertenly removed during the adjustment process and allow for faster assembly and disassembly of the tool.

Figure 4:
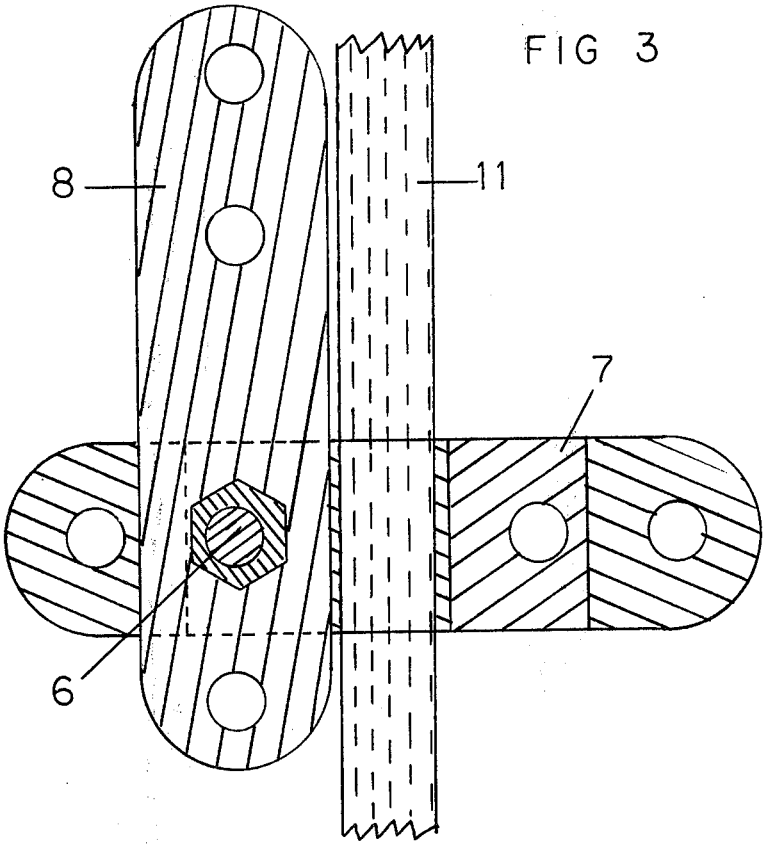
FIG. 4 shows the lifting collar from a face on view with one retaining bolt installed to allow the collar to hinge open for ease of passing the sucker rod between the two parts of the collar without complete disassembly.

FIG. 4 shows the lifting collar 7 and cap 8 as they appear when partially assembly for quick and easy installation. A single bolt and nut 6 loosly installed, allows the cap 8 to be rotated to a perpindicular position and the sucker rod 11 is placed between the lifting collar 7 protrusions and the cap 8 is then rotated back to the parallel where the holes are aligned and bolted.

In operation with the tool installed as shown in FIG. 1, hydraulic pressure is supplied from a conventional means to the hydraulic servos 4 via the port 13. Both cylinders 4 are supplied from a common source so that an equal amount of pressure applied to both hydraulic servos 4 to insure equal load distribution and a straight lift. As the servos 4 retract the lifting collar 7 and cap 8 are drawn upward, contact is made with sucker rod clamp 10B which in turn moves the sucker rod 11 up through the supporting member 1. As the sucker rod 11 continues to move upward rod clamp 10A moves up and away from supporting member 1. When the desired adjustment has been reached the rod clamp 10A is loosened and slid down the sucker rod 11 until it is in contact with the supporting member 1 and then rod clamp 10A is tightened. Hydraulic prressure is then released from the servos so that weight of the sucker rod 11 causes rod clamp 10A to contact the supporting member 1. The weight is then releived on rod clamp 10B which can now be removed or repositioned if additional adjustment is required. The sucker rod 11 can also be lowered by simply reversing the lifting procedure.

We claim:

1. A sucker rod adjustment tool comprised of two cable type suspension slings, with two bolts and nuts two hydraulic servos, a lifting collar base, a lifting collar cap, with two bolts with nuts and two pins with retaining clips; said slings each being of equal and sufficient length as to allow ample room to attach a hydraulic servo when the said sling is draped across the sucker rod support member, said sling forming a loop, the said sling having a swaged eye type fitting at each end for the purpose of attaching a hydraulic servo by passing a bolt through one end fitting eye of the said sling, through the base pivot eye of the said hydraulic servo, through the opposited end eye fitting of the said sling, said assembly being retained in such an arrangement by a nut on the said bolt, the said slings thus suspend and support the said hydraulic servos below the sucker rod support member; the said hydraulic servos having attached to the rod end eyes a lifting collar base and lifting collar cap by means of a pin and retaining clip, said pin passing first through the lifting collar base, through the piston rod eye and through the lifting collar cap, said lifting collar base having two protrusions near its center, on the inner face, said protrusions being of ample dimensions and having sufficient separation as to allow various size of sucker rod to be unemcumbered when passed between the said protrusions, the said lifting collar cap forming a four sided enclosure between the said base and two protrusions when firmly secured in place by two bolts passing through the said base at a point to be outboard the center of each protrusion, the said cap having like holes communicating with the said bolt holes through the said base, a conventional sucker rod clamp installed around the sucker rod above the said lifting collar base and said lifting collar cap for the purpose of transmitting the lifting force to the sucker rod when the retraction of the said hydraulic servos raises the said lifting collar and cap.

2. A sucker rod adjustment tool as set forth in claim 1 wherein the said tool is suspended and supported by means of two equal length cable slings, said slings having an eye type swaged fitting on each end for the purpose of attaching said cable sling to the said hydraulic servos, such an arrangement making the tool adaptable to all sizes and shapes of sucker rod support members in use.

3. A sucker rod adjustment tool as set forth in claim 1 wherein the said lifting collar base having two protrusions upon its inside face, said protrusions being of ample dimensions and with sufficient separation as to allow sucker rod of various sizes to pass unemcumbered between the two protrusions of the lifting collar base and lifting collar cap, the said lifting collar cap being secured to the said lifting collar base by two bolts passing through two holes, said holes being located so as to pass through the lifting collar protrusions at a point outboard of their centers on a center line running longitudinally from end to end, with sufficient seperation to allow the said cap to rotate and clear the area between the protrusions of the said lifting collar base when one bolt is loosely installed, said lifting collar cap having like holes communicating with said holes through said lifting collar base, said lifting collar base and said lifting collar cap having like holes at their outer ends for the purpose of attaching the piston rod eye end of the said hydraulic servos by passing pins through the said lifting collar base, through the said piston rod eye and through the said lifting collar cap, so as when the said hydraulic servos are retracted the force is transmitted to a sucker rod clamp thereby raising the sucker rod through the supporting member.

* * * * *